US007659045B2

(12) United States Patent
Shibai et al.

(10) Patent No.: US 7,659,045 B2
(45) Date of Patent: Feb. 9, 2010

(54) METHOD FOR MANUFACTURING TONER AND TONER

(75) Inventors: Yasuhiro Shibai, Yamatokoriyama (JP); Satoru Ariyoshi, Nara (JP); Katsuru Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 339 days.

(21) Appl. No.: 11/705,504

(22) Filed: Feb. 13, 2007

(65) Prior Publication Data

US 2007/0196756 A1 Aug. 23, 2007

(30) Foreign Application Priority Data

Feb. 20, 2006 (JP) ..... P2006-043073

(51) Int. Cl.
*G03G 9/08* (2006.01)

(52) U.S. Cl. ..... 430/137.14; 430/108.1; 430/105

(58) Field of Classification Search ..... 430/108.1, 430/137.14, 105
See application file for complete search history.

(56) References Cited

U.S. PATENT DOCUMENTS

| | | | | |
|---|---|---|---|---|
| 5,424,162 | A | 6/1995 | Kohri et al. | |
| 5,514,636 | A * | 5/1996 | Takeuchi | 503/207 |
| 5,935,751 | A | 8/1999 | Matsuoka et al. | |
| 5,994,020 | A * | 11/1999 | Patel et al. | 430/137.14 |
| 6,190,820 | B1 * | 2/2001 | Patel et al. | 430/137.17 |
| 6,503,680 | B1 | 1/2003 | Chen et al. | |
| 7,569,322 | B2 | 8/2009 | Yuasa et al. | |
| 2005/0041523 | A1 | 2/2005 | Nakano | |
| 2005/0175923 | A1 | 8/2005 | Nakazawa et al. | |
| 2006/0263711 | A1 * | 11/2006 | Yuasa et al. | 430/108.4 |
| 2007/0196754 | A1 * | 8/2007 | Matsumoto et al. | 430/105 |
| 2008/0268368 | A1 | 10/2008 | Yuasa et al. | |

FOREIGN PATENT DOCUMENTS

| | | |
|---|---|---|
| CN | 1652033 A | 8/2005 |
| JP | 06-161153 | 6/1994 |
| JP | 09-277348 | 10/1997 |
| JP | 10-207116 A | 8/1998 |
| JP | 10-301333 | 11/1998 |
| JP | 11-2922 | 1/1999 |
| JP | A 2000-122334 | 4/2000 |

(Continued)

OTHER PUBLICATIONS

U.S. Office Action mailed Jun. 19, 2009 in corresponding U.S. Appl. No. 11/705,468.

*Primary Examiner*—John L Goodrow
(74) *Attorney, Agent, or Firm*—Nixon & Vanderhye P.C.

(57) ABSTRACT

Resin particles containing at least binding resin and wax particles having a diameter of 30 to 600 nm are coagulated, and a resulting coagulated product is heated. Such wax particles are manufactured, for example, by way of a coarse particle preparing step, a slurry preparing step, a pulverizing step, a cooling step, and a depressurizing step. Slurry of wax coarse particles obtained by way of the coarse particle preparing step and the slurry preparing step is directed under heat and pressure through a pressure-resistant nozzle whereby the wax coarse particles are pulverized into the wax particles at the pulverizing step. The cooling step and the depressurizing step are disposed just after the pulverizing step to prevent the wax particles from coarsening.

10 Claims, 1 Drawing Sheet

FOREIGN PATENT DOCUMENTS

| | | |
|---|---|---|
| JP | 2001-228651 | 8/2001 |
| JP | 2004-189765 | 7/2004 |
| JP | 2005-31222 A | 2/2005 |
| JP | 2005-165039 | 6/2005 |
| JP | A 2006-039515 | 2/2006 |
| WO | 03/059497 | 7/2003 |
| WO | WO 2005/013012 | 2/2005 |

* cited by examiner

METHOD FOR MANUFACTURING TONER AND TONER

CROSS-REFERENCE TO RELATED APPLICATION

This application claims priority to Japanese Patent Application No. JP 2006-43073, which was filed on Feb. 20, 2006, the contents of which, are incorporated herein by reference, in their entirety.

BACKGROUND OF THE INVENTION

1. Field of the Invention

The present invention relates to a method for manufacturing a toner, and to a toner.

2. Description of the Related Art

An electrophotographic image forming apparatus comprises an image forming process mechanism including a photoreceptor; a charging section for charging a surface of the photoreceptor; an exposure section for irradiating the surface of the photoreceptor being charged with signal light to form thereon an electrostatic latent image corresponding to image information; a developing section for supplying a toner contained in a developer to the electrostatic latent image formed on the surface of the photoreceptor to form thereon a toner image; a transfer section provided with a transfer roller for transferring the toner image formed on the surface of the photoreceptor to a recording medium; a fixing section provided with a fixing roller for fixing the toner image onto the recording medium; and a cleaning section for cleaning the surface of the photoreceptor after the toner image has been transferred. In the electrophotographic image forming apparatus, the electrostatic latent image is developed using a one-component developer containing a toner as a developer, or a two-component developer containing a toner and a carrier as developers to form an image.

The electrophotographic image forming apparatus can form an image having fine image quality at high speeds and low costs, thereby being utilized for copying machines, printers, facsimiles and the like, along with remarkable popularization thereof in recent years. Simultaneously, the image forming apparatus has encountered more demanding requirements. Among such requirements, requirements to fulfill high-definition, high-resolution, high-quality stability, and an increase in an image forming speed and the like in an image formed by the image forming apparatus have attracted particular attentions. To achieve these requirements, it is essential to consider a two-way approach from an image forming step point of view and a developer point of view. In respect with an approach to high-definition and high-resolution in the image, as long as the developer concerned, one of the problems to be solved is to reduce a diameter of toner particles based on the perspective that it is important to precisely reproduce the electrostatic latent image. The toner particles are typically resin particles in which a wax as a colorant and a releasing agent are dispersed in binder resin as a matrix, resulting that it is difficult to reduce a particle diameter of the wax dispersed in the binder resin by typical methods for manufacturing toner particles having a reduced diameter. Accordingly, there is a problem that the wax bleeds out as time advances from the toner particles having a reduced diameter that have been manufactured onto a surface of the toner particles, thus causing toner filming on the surface of the photoreceptor. Moreover, a great amount of wax bleeds out onto a surface of the toner particles and thereby the wax is melt to have viscosity especially at a high temperature. As a result, an offset phenomenon that the toner is adhered to the transfer roller and the fixing roller and the like without being transferred or fixed to a recording medium, may frequently occur.

As a method for reducing the particle diameter of the wax, for example, in Japanese Unexamined Patent Publication JP-A 6-161153 (1994) there has been proposed a method for manufacturing a toner including a mixing step in which at least 100 parts by weight of thermoplastic resin and 1 to 7 parts by weight of wax are mixed, a melt-kneading step in which a mixture obtained in the mixing step is melt-kneaded and its melt-kneading temperature is in a range of (Tm−20) to (Tm+20)° C. (Tm: a melting temperature of the thermoplastic resin) and a melt-kneaded product after the melt-kneading step has a temperature of (Tm+35)° C. or less, and a pulverizing-classifying step in which the melt-kneaded product obtained in the melt-kneading step is cooled, pulverized, and classified. Additionally, in a method for manufacturing a toner in which a mixture of toner raw materials is melt-kneaded, and a resulting melt-kneaded material is cooled, pulverized and classified, there has been proposed a method for manufacturing a toner, in which the mixture of the toner raw materials is melt-kneaded using an extruder/kneader configured so that a slide-shaped discharging part inclining downward is coupled on an outlet of a cylinder part internally having a kneading-conveying member for kneading and conveying the mixture of the toner raw materials, as disclosed in Japanese Unexamined Patent Publication JP-A 9-277348 (1997), for example. These methods for manufacturing a toner are intended to prevent occurrence of the toner filming on the photoreceptor due to bleeding out of the wax, the offset phenomenon and the like by reducing a particle diameter of the wax contained in the toner particles. However, these methods, which are basically a melt-kneading method that is conventionally known, fail to contribute to sufficient particle diameter reduction of the toner itself, even though the particle diameter of the wax may have been successfully reduced. Therefore, the toner particles obtained are not sufficiently satisfactory in image reproducibility, particularly, in high-definition and high-resolution.

Meanwhile, in International Publication WO03/059497, for example, there has been proposed an emulsifying/dispersing apparatus including an emulsifying/dispersing section for emulsifying and dispersing emulsifying materials into liquid as a matrix by a shear force, a leading passage for supplying the emulsified liquid under pressure that is obtained by the emulsifying/dispersing section to a multistage depressurizing section, a heat exchanging section provided on the leading passage, and the multistage depressurizing section for depressurizing the emulsified liquid supplied from the leading passage down to such a level that the emulsified liquid discharged into the atmosphere causes no bubbling, and then discharging the emulsified liquid. The emulsifying/dispersing apparatus disperses the emulsifying materials into the liquid under pressure to prepare the emulsified liquid in which the emulsifying materials are uniformly dispersed, and then depressurizes in a stepwise manner the emulsified liquid finally down to such a level that the emulsified liquid causes no bubbling to prevent the particles of the emulsifying materials dispersed in the emulsified liquid from coarsening, thus obtaining the objective emulsified liquid in which the particles of the emulsifying materials having a uniform diameter is dispersed. By using the emulsifying/dispersing apparatus provided with the multistage depressurizing section, a high share force can be applied in the emulsifying/dispersing section to readily produce emulsion composed of water and oil, and the like, for example. However, when it is merely intended to obtain the toner particles using this apparatus, it is difficult to control the particle diameter, resulting that the desired toner particles having a reduced diameter cannot be obtained. WO03/059497 has no disclosure about application of this emulsifying/dispersing apparatus to a manufacturing method for toner particles. Moreover, WO03/059497 has no suggestion that when the emulsifying/dispersing apparatus disclosed in WO03/059497 is applied for a method for toner particles, not only is toner particles having a reduced diameter obtained, but a toner in which wax having a more reduced diameter than the reduced diameter of the toner particles is uniformly dispersed in the toner particles is obtained.

SUMMARY OF THE INVENTION

An object of the invention is to provide a toner which is excellent in image reproducibility and capable of forming a high quality image with high-definition and high-resolution, and which prevents occurrence of toner filming on a surface of a photoreceptor due to bleeding out of a wax, an offset phenomenon in a high-temperature range, or the like, as well as a method for manufacturing the toner.

After keen examinations to solve the above problems, the inventors have found that a desired toner can be obtained not by merely giving a shearing force to water-based slurry containing coarse particles of binder resin, but by letting the water-based slurry under heat and pressure pass through a pressure-resistant nozzle to thereby pulverize the coarse particles of binder resin, followed by cooling and then depressurizing the obtained water-based slurry in a stepwise manner to produce binder resin particles having a reduced diameter, which are coagulated with other toner components such as a colorant. The inventors have thus achieved the invention.

The invention provides a method for manufacturing a toner, comprising:

coagulating resin particles including at least binder resin, and wax particles having a diameter in a range of 30 to 600 nm obtained from slurry containing wax coarse particles by a high-pressure homogenizer method; and heating a resulting coagulated product.

In accordance with the invention, the resin particles including at least the binder resins, and the wax particles having a diameter in a range of 30 to 600 nm obtained from the slurry containing wax coarse particles by the high-pressure homogenizer method are coagulated and a resulting product is heated to obtain the toner having a reduced diameter in which the wax is uniformly dispersed. Therefore, the toner is, by virtue of reduction of its diameter, excellent in reproducibility of an original image and capable of forming a high-definition and high-resolution image of high quality. Moreover, since the wax having fine particles are uniformly dispersed, the wax is very hard to bleed out, so that occurrence of the toner filming on a surface of the photoreceptor, the offset phenomenon in a high-temperature range, or the like is surely prevented. In addition, when an image is formed by using the toner, transfer efficiencies of a toner image from the photoreceptor to a recording medium, from the photoreceptor to an intermediate medium, and from the intermediate medium to the recording medium are enhanced, thus achieving reduction of toner consumption.

Further, in the invention, it is preferable that the high-pressure homogenizer method includes a pulverizing step for obtaining heated and pressurized slurry containing wax particles by passing the slurry containing wax coarse particles through a pressure-resistant nozzle under heat and pressure and pulverizing the wax coarse particles; a cooling step for cooling down the slurry obtained at the pulverizing step; and a depressurizing step for gradually depressurizing the slurry cooled down at the cooling step to a pressure level at which no bubbling is caused.

In accordance with the invention, extremely fine wax particles having a diameter in a range of 30 to 600 nm are obtained by a method using the high-pressure homogenizer including the pulverizing step, the cooling method and the depressurizing step (which is preferably a multistage depressurizing step). This is because the slurry containing wax coarse particles is directed under heat and pressure through the pressure-resistant nozzle and thereby the wax coarse particles are pulverized to prepare the slurry including the wax particles at the pulverizing step, and the cooling step is disposed just after the pulverizing step to cool the slurry, and subsequently the slurry is gradually depressurized down to such a level that the slurry causes no bubbling at the depressurizing step, thereby preventing the bubbling in the slurry and eventually preventing the wax particles from coarsening due to recoagulation.

Further, in the invention, it is preferable that the slurry containing wax coarse particles is slurry prepared by dispersing the wax coarse particles into water.

In accordance with the invention, in the slurry containing wax coarse particles, the use of water as liquid for dispersing the wax coarse particles can simplify process control at subsequent steps and facilitate disposal of liquid waste that stems from production of the wax particles. Therefore, the use of the water can improve productivity in producing the wax particles and can reduce costs.

Further, in the invention, it is preferable that the slurry containing wax coarse particles is slurry prepared by dispersing the wax coarse particles into a mixture of water and a dispersion stabilizer.

In accordance with the invention, in the slurry containing wax coarse particles, the use of water containing a dispersion stabilizer as liquid for dispersing the wax coarse particles remarkably suppresses coarsening of the wax particles due to the bubbling at steps following a step of preparing the slurry, thus allowing further reduction of a diameter of the wax particles finally obtained, further uniformity of a diameter and a shape of the wax particles, and further simplification of process control.

Further, in the invention, it is preferable that the slurry is pressurized at a pressure in a range from 50 MPa to 250 MPa, and heated to 50° C. or more at the pulverizing step.

Further, in the invention, it is preferable that the slurry is pressurized at a pressure in a range from 50 MPa to 250 MPa, and heated to a melting point of the wax or more at the pulverizing step.

In accordance with the invention, at the pulverizing step, the slurry is pressurized to 50 MPa or more and 250 MPa or less and heated to 50° C. or more (preferably a melting point of the wax or more), thereby surely allowing reduction of an amount of bubbles down to below an amount that can influence a particle diameter of the wax particles, easier operation of particle diameter control and particle diameter reduction, and a high yield in production of the wax particles having a uniform and reduced diameter.

Further, in the invention, it is preferable that the pressure-resistant nozzle is a multiple nozzle.

Furthermore, in the invention, it is preferable that the pressure-resistant nozzle is a nozzle having a liquid flowing passage therein provided with at least one collision wall against which a liquid flowing through the liquid flowing passage collides.

In accordance with the invention, as the pressure-resistant nozzle, the use of a multiple nozzle or a nozzle having the liquid flowing passage therein provided with at least one collision wall against which the liquid flowing through the liquid flowing passage collides, can stably reduce the wax particle diameter, and can prevent the wax particles from undergoing coagulation and coarsening due to particle-particle contact of the wax particles having a reduced diameter.

In addition, in the invention, it is preferable that at the depressurizing step, a pressure on the slurry is gradually reduced to a level at which no bubbling is caused by passing the pressurized slurry containing wax particles, which is cooled down at the cooling step, through a multistage depressurization apparatus for performing stepwise depressurization.

In accordance with the invention, at the depressurizing step, the pressurized slurry containing toner particles, cooled down at the cooling step is made to pass through the multistage depressurization apparatus for performing stepwise depressurization, and the pressure on the slurry is gradually reduced to a level at which no bubbling is caused, resulting that prevention of the bubbling is further ensured and the wax particles not having the wax particles coagulated and coarsened by an effect of the bubble are obtained.

Furthermore, in the invention, it is preferable that the multistage depressurization apparatus comprises:

an inlet passage for leading the pressurized slurry containing wax particles into the multistage depressurization apparatus;

an outlet passage in communication with the inlet passage, for discharging the slurry containing wax particles to outside of the multistage depressurization apparatus; and a multistage depressurizing section disposed between the inlet passage and the outlet passage, to which two or more depressurizing members are coupled via coupling members, for performing stepwise depressurization.

In accordance with the invention, at the depressurizing step, by using the multistage depressurizing apparatus including: the inlet passage for leading the pressurized slurry containing wax particles after completion of the cooling step; the outlet passage in communication with the inlet passage, for discharging the depressurized slurry containing wax particles to outside; and the multistage depressurizing section disposed between the inlet passage and the outlet passage, on which two or more depressurization members are coupled via the coupling members, the slurry containing wax particles under pressure can be smoothly depressurized down to such a level that the slurry causes no bubbling.

In the invention, it is preferable that the binder resin is acrylic resin.

In accordance with the invention, by using the acrylic resin as the binder resin, it is especially easy to achieve particle diameter reduction of the toner obtained.

Also, the invention provides a toner manufactured by any one of the above methods for manufacturing a toner.

In accordance with the invention, there is provided the toner obtained by the manufacturing method of the invention. As described above, the toner has various advantages such that the toner is excellent in image reproducibility and hard to cause the toner filming on a photoreceptor and the offset phenomenon in a high temperature, a transfer efficiency of the toner is high, and a consumption of the toner for image formation per one sheet is smaller than that of a conventional toner.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
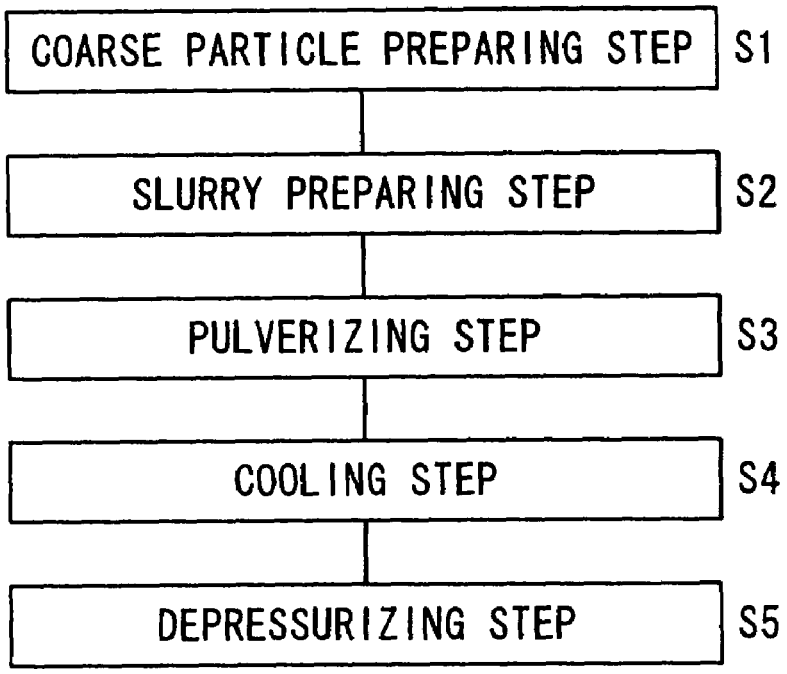
FIG. 1 is a flowchart illustrating a method for manufacturing a toner according to a first embodiment of the invention.

Now referring to the drawings, preferred embodiments of the invention are described in detail below.

In the invention, resin particles containing at least binder resins, and wax particles having a particle diameter in a range of 30 to 600 nm that are obtained by a high-pressure homogenizer method, are mixed and coagulated and a resulting coagulated product is heated to produce a toner. That is, a manufacturing method of the invention includes (A) a wax particle preparing step and (B) a toner manufacturing step.

(A) Wax Particle Preparing Step:

Wax particles are manufactured by the high-pressure homogenizer method. The high-pressure homogenizer method is herein a method for obtaining fine particles or coarse particles of a synthetic resin, a wax and the like by using a high-pressure homogenizer, and the high-pressure homogenizer is herein an apparatus for pulverizing particles under pressure. As the high-pressure homogenizer, it is possible to use commercially available products or those disclosed in patent documents or the like. Examples of the high-pressure homogenizers commercially available include chamber type high-pressure homogenizers such as Microfluidizer (trade name, manufactured by Microfluidics Co., Ltd.), Nanomizer (trade name, manufactured by Nanomizer Co., Ltd.), Ultimizer (trade name, manufactured by Sugino Machine Ltd.), High-Pressure Homogenizer (trade name, manufactured by Rannie Co., Ltd.), High-Pressure Homogenizer (trade name, manufactured by Sanmaru Machinery Co., Ltd.), and High-Pressure Homogenizer (trade name, manufactured by Izumi Food Machinery Co., Ltd.). Also, examples of the high-pressure homogenizers disclosed in patents documents include high-pressure homogenizers disclosed in WO03/059497. Among these machines preferable is a high-pressure homogenizer disclosed in WO03/059497. FIG. 1 shows one example of a method for manufacturing resin particles using the high-pressure homogenizer. FIG. 1 is a flowchart schematically illustrating a manufacturing method for the wax particles. The manufacturing method shown in FIG. 1 includes a coarse particle preparing step S1, a slurry preparing step S2, a pulverizing step S3, a cooling step S4, and a depressurizing step S5. Among these steps, the high-pressure homogenizer method using the high-pressure homogenizer disclosed in WO03/059497 includes the pulverizing step S3, the cooling step S4, and the depressurizing step S5. A method for manufacturing the resin particles as shown in FIG. 1 will be specifically described below.

[Coarse Particle Preparing Step S1]

At the coarse particle preparing step S1, wax coarse particles are obtained by coarsely pulverizing a wax. Examples of a method for coarsely pulverizing the wax include, but not be limited to, a method for mechanically pulverizing the wax or the like. For example, there can be used typical powder mills such as a cutter mill, a feather mill, and a jet mill for mechanically and coarsely pulverizing the wax. A particle diameter of the wax coarse particles includes, but not be limited to, preferably a range of around 50 to 1,000 μm, more preferably a range of around 100 to 500 μm. It is possible to use the wax commonly used in an electrophotographic image forming field and capable of granulation in its molten state. Examples of the wax include petroleum waxes such as a paraffin wax and a derivative thereof, and a microcrystallin wax and a derivative thereof; hydrocarbon synthesis waxes such as a Fischer-Tropsch wax and a derivative thereof, a polyolefin wax and a derivative thereof, a low-molecular weight polypropyrine wax and a derivative thereof, and polyolefin polymer wax (low-molecular weight polyethylene wax etc.) and a derivative thereof; plant-based waxes such as a carnauba wax and a derivative thereof, a rice wax and a derivative thereof, a candelilla wax and a derivative thereof, a wood wax; animal-based waxes such as a bee wax, and a whale wax; fat and oil synthesis waxes such as fatty acid amide, and phenol fatty acid ester; long-chain carboxylic acid and derivatives thereof; long-chain alcohol and derivatives thereof; silicone polymer; and higher fatty acid. Note that the derivatives include an oxide, a block copolymer of a vinyl monomer and a wax, and a graft denatured product of a vinyl monomer and a wax.

[Slurry Preparing Step S2]

At the slurry preparing step S2, the wax coarse particles obtained at the coarse particle preparing step are mixed with liquid, and dispersed into the liquid to prepare the slurry containing wax coarse particles. There is no limitation to the liquid mixed with the wax coarse particles, as long as the liquid is a fluid substance that can uniformly disperse the wax coarse particles without solving the wax coarse particles. In view of easiness of process control, liquid waste disposal after completion of all steps, and the like, the liquid is preferably water, more preferably water containing a dispersion stabilizer, and is especially preferably water containing the dispersion stabilizer and a surface-active agent. It is preferable that the dispersion stabilizer is added to water before the wax coarse particles are added to the water. A usage of the dispersion stabilizer includes, but not be limited to, preferably a range of 0.05% to 15% by weight based on a total amount of the wax and the dispersion stabilizer, more preferably a range of 1% to 10% by weight based thereon. When the dispersion stabilizer and the surface-active agent are used in combination, this usage is also equivalent to a usage in the case of using the dispersion stabilizer alone. Any of the dispersion stabilizers that are commonly used in this field can be used, but a water-soluble polymer dispersion stabilizer is preferable among such dispersion stabilizers. Examples of the water-soluble polymeric dispersant include: polyoxyethylene polymers such as (meth)acrylic polymer, polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester; cellulose polymers such as methylcellulose, hydroxyethylcellulose, and hydroxypropylcellulose; polyoxyalkylene alkylarylether sulfate salts such as sodium polyoxyethylene laurylphenylether sulfate, potassium polyoxyethylene laurylphenylether sulfate, sodium polyoxyethylene nonylphenylether sulfate, sodium polyoxyethylene oleylphenylether sulfate, sodium polyoxyethylene cetylphenylether sulfate, ammonium polyoxyethylene laurylphenylether sulfate, ammonium polyoxyethylene nonylphenylether sulfate, and ammonium polyoxyethylene oleylphenylether sulfate; and polyoxyalkylene alkylether sulfate salts such as sodium polyoxyethylene laurylether sulfate, potassium polyoxyethylene laurylether sulfate, sodium polyoxyethylene oleylether sulfate, sodium polyoxyethylene cetylether sulfate, ammonium polyoxyethylene laurylether sulfate, and ammonium polyoxyethylene oleylether sulfate, which contains one or two hydrophilic monomers selected from: acrylic monomers such as (meth)acrylic acid, α-cyanoacrylate, α-cyanomethacrylate, itaconic acid, crotonic acid, fumaric acid, maleic acid, and maleic acid anhydride; hydroxyl-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylic ester, diethylene glycol monomethacrylic ester, glycerine monoacrylic ester, and glycerine monomethacrylic ester; vinyl alcohol monomers such as N-methylol acrylamide and N-methylol methacrylamide; vinylalkylether monomers such as vinylmethylether, vinylethylether, and vinylpropylether; vinylalkylester monomers such as vinyl acetate, vinyl propionate, and vinyl butyrate; aromatic vinyl monomers such as styrene, α-methylstyrene, and vinyl toluene; amide monomers such as acrylamide, methacrylamide, diacetone acrylamide, and methylol compounds thereof; nitrile monomers such as acrylonitrile and methacrylonitorile; acid chloride monomers such as chloride acrylate and chloride methacrylate; vinyl nitrogen-containing heterocyclic monomers such as vinylpyridine, vinylpyrrolidone, vinylimidazole, and ethyleneimine; and cross-linking monomers such as ethyleneglycol dimethacrylate, diethyleneglycol dimethacrylate, allyl methacrylate, and divinylbenzene. The water-soluble polymer dispersion stabilizers can be used alone or in combination. Examples of the surface-active agent include sodium dodecylbenzene sulfate, sodium tetradecyl sulfate, sodium pentadecyl sulfate, sodium octyl sulfate, sodium oleate, sodium laurylate, sodium stearate, and potassium stearate. The surface-active agents may be used alone or in combination.

The wax coarse particles and the liquid are mixed by using typical mixers to obtain the slurry of the wax coarse particles. Here, an amount of the wax coarse particles being added to the liquid includes, but not be limited to, preferably a range of 3% to 45% by weight based on a total amount of the wax coarse particles and the liquid, more preferably a range of 5% to 30% by weight based thereon. In addition, the wax coarse particles and the liquid may be mixed under a pressurized or cooled condition, but are generally mixed at a room temperature. Examples of the mixer include, Henschel type mixers such as Henschel Mixer (trade name, manufactured by Mitsui Mining Co., Ltd.), Super Mixer (trade name, manufactured by KAWATA MFG. Co., Ltd.), and Mechanomill (trade name, manufactured by Okada Seiko, Co., Ltd.); Angmill (trade name, manufactured by Hosokawa Micron KK); Hybridization System (trade name, manufactured by Nara Machinery Co., Ltd.); and Cosmo System (trade name, manufactured by Kawasaki Heavy Industries, Ltd.). The resulting slurry containing wax coarse particles may be directly applied to the pulverizing step. However, for example, a particle diameter of the wax coarse particles in the slurry may be reduced to preferably around 100 μm, more preferably 100 μm or less by typical pulverizing treatment as pretreatment. For example, the pulverizing treatment is performed by directing the slurry of the wax coarse particles through a nozzle under high pressure.

[Pulverizing Step S3]

At the pulverizing step S3, the slurry containing wax coarse particles obtained at the slurry preparing step is directed through a pressure-resistant nozzle under heat and pressure. The wax coarse particles are thus pulverized to produce the wax particles and then to obtain the slurry containing wax particles. A pressurizing and heating condition for the slurry containing wax coarse particles is not limited to a particular condition. The slurry is preferably pressurized to 50 to 250 MPa and heated to 50° C. or more, and more preferably pressurized to 50 to 250 MPa and heated to a melting point of the wax or more, and especially preferably pressurized to 50 to 250 MPa and heated to a temperature in a range of the melting point of the wax to (Tm+25)° C. (Tm: a half softening temperature measured by a flow tester). When the slurry is pressurized to less than 50 MPa, shear energy is decreased to cause a risk that insufficient particle diameter reduction occurs. When the slurry is pressurized to more than 250 MPa, this condition is unpractical since a risk in an actual manufacturing line excessively increases. The slurry containing wax coarse particles is directed into the pressure-resistant nozzle through the inlet thereof under the pressurizing and heating condition in the aforesaid range.

Figure 2:
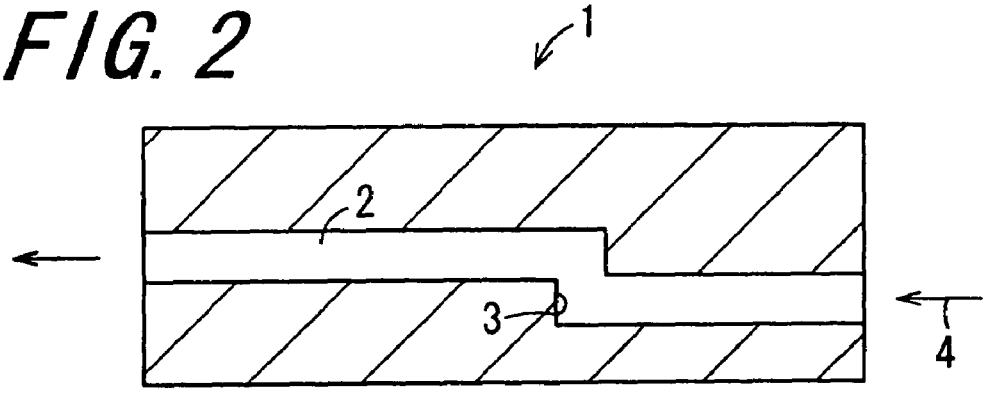
FIG. 2 is a section view schematically illustrating a configuration of a pressure-resistant nozzle.

As the pressure-resistant nozzle, it is possible to use a typical pressure-resistant nozzle capable of flowing fluid. For example, a multiple nozzle having a plurality of liquid flowing passages can be preferably used. The liquid flowing passage constituting the multiple nozzle may be concentrically arranged centering around an axis line of the multiple nozzle, or the plurality of liquid flowing passages may be arranged substantially parallel to one another in a longitudinal direction of the multiple nozzle. One example of the multiple nozzle used in the manufacturing method of the invention includes a nozzle provided with one or more, preferably one or two liquid flowing passages having an inlet diameter and an outlet diameter of around 0.05 to 0.35 mm and a length of 0.5 to 5 cm. Also, the pressure-resistant nozzle includes the nozzle shown in FIG. 2. FIG. 2 is a section view schematically illustrating a configuration of a pressure-resistant nozzle 1. The pressure-resistant nozzle 1 includes a liquid flowing passage 2 therein, and the liquid flowing passage 2 is bent in a form of a hook, and includes at least one collision wall 3 against which the slurry containing wax coarse particles, which flows into the liquid flowing passage in a direction of an arrow 4, collides. The slurry containing wax coarse particles collides against the collision wall 3 at a substantially right angle and thereby the wax coarse particles are pulverized to produce toner particles having a more reduced diameter and then discharged from the pressure-resistant nozzle 1. In the pressure-resistant nozzle 1, the inlet is formed to have a diameter identical to a diameter of the outlet. Without being restricted in such a manner, the outlet may be formed to have a diameter shorter than a diameter of the inlet. The slurry discharged from the outlet of the pressure-resistant nozzle includes, for example the wax particles having a diameter reduced to a range of around 30 to 600 nm, is heated to a range of 60 to Tm+60° C. (Tm is the same as above-mentioned), and is pressurized to a range of around 10 to 50 MPa. The pressure-resistant nozzle may be provided alone or in combination.

[Cooling Step S4]

At the cooling step, the slurry containing wax particles having a reduced diameter under heat and pressure, which is discharged from the pressure-resistant nozzle, is cooled. There is no limitation to a cooling temperature. However, to give one target, for example the slurry may be cooled in such a manner that pressure applied to the slurry is reduced to a range of around 5 to 80 MPa when cooled to a temperature of 30° C. or less. Any typical fluid cooling machines having a pressure-resistant structure can be applied for cooling, and among such cooling machines preferable is a cooling machine having a wide cooling area such as a corrugated tube type cooling machine. Also, it is preferable that the fluid cooling machine is configured so that a cooling gradient from an inlet of the cooling machine to an outlet thereof is increased (or cooling capability therefrom/thereto is decreased). As a result, reduction of the wax particle diameter is even more efficiently achieved. Also, coarsening of the wax particles due to mutual reattachment of the wax particles is prevented, allowing enhancement in yield of the wax particles having a reduced diameter. For example, the slurry containing wax particles having a reduced diameter, which is discharged from the pressure-resistant nozzle at the previous step, is directed from the inlet of the cooling machine into the cooling machine, cooled within the cooling machine having the cooling gradient, and is discharged from the outlet of the cooling machine. The cooling machine may be disposed alone or in combination.

Depressurizing Step S5:

At the depressurizing step S5, the slurry containing wax particles under pressure, which is obtained at the cooling step S4, is depressurized down to such a level that the slurry causes no bubbling. The slurry led from the cooling step S4 to the depressurizing step S5 is pressurized to around 5 to 80 MPa. It is preferable that the slurry is gradually depressurized in a stepwise manner.

A multistage depressurizing apparatus disclosed in WO03/059497 is preferably used for this depressurizing operation. The multistage depressurizing apparatus is configured so as to include an inlet passage for directing the slurry containing wax particles under pressure into the multistage depressurizing apparatus, an outlet passage arranged to communicate with the inlet passage, for discharging the slurry containing wax particles depressurized to an outside of the multistage depressurizing apparatus, and a multistage depressurizing section disposed between the inlet passage and the outlet passage, to which more than one depressurizing member is linked via linking members. Examples of the depressurizing member used for the multistage depressurizing section in the multistage depressurizing apparatus include a pipe-shaped member. Examples of the linking member include a ring-shaped seal. The multistage depressurizing apparatus is configured by linking the plurality of pipe-shaped members having various inner diameters to each other using the ring-shaped seal. For example, from the inlet passage toward the outlet passage, two to four pipe-shaped members having a common diameter are linked to each other, and to these pipe-shaped members is then one pipe-shaped member having a inner diameter about twice larger than that of these pipe-shaped members linked, and to these pipe-shaped members are further one to three pipe-shaped members having a inner diameter around 5% to 20% smaller than that of the one pipe-shaped member further linked. As a result, the slurry containing wax particles flowing through the pipe-shaped members is gradually depressurized and finally depressurized down to such a level that the slurry causes no bubbling, preferably to the atmospheric pressure. A heat exchange section employing a cooling medium and a heating medium may be disposed around the multistage depressurizing section to cool or heat in accordance with a pressure value applied to the slurry containing wax particles. The one multistage depressurizing apparatus may be disposed or the plurality of multistage depressurizing apparatuses may be disposed in tandemly-arranged manner or in parallel. The slurry containing wax particles under pressure obtained at the cooling step S4 is directed from the cooling step S4 into the depressurizing step S5 via a pressure-resistant pipe, which is disposed between a part designed for the cooling step S4 and a part designed for the depressurizing step S5 and has one end of the pressure-resistant piping connected to the outlet of the cooling machine and the other end of the pressure-resistant pipe connected to the inlet passage of the multistage depressurizing apparatus, depressurized within the multistage depressurizing apparatus, and discharged from the outlet passage to an outside of the multistage depressurization apparatus.

Accordingly, the slurry containing wax particles having a reduced diameter is obtained. This slurry can be directly used at the toner manufacturing step (B). Also, the wax particles having a reduced diameter that are isolated from the slurry may be used for a new slurry. To isolate the wax particles from the slurry, typical isolation devices such as a filtration device and a centrifuge is employed. The particle diameter of the wax particles obtained at this step is preferably 30 to 600 nm, more preferably 50 to 550 nm, and especially preferably 80 to 500 nm. In addition, at this step, a powdering method including the steps of S1 to S5 as described above may be implemented only once, or thereafter the steps of S3 to S5 may be repeated. Moreover, at this step, particle diameter reduction of the binder resin in addition to the wax may be implemented. In such a case, it is preferable that the particle diameter reduction of the binder resin and the wax is individually implemented depending on ingredients.

(B) Toner Manufacturing Step:

At this step, the slurry containing wax particles and toner raw materials other than the wax are mixed and coagulated, and a resulting coagulated product is heated to produce the toner. The step includes, for example a toner raw material mixture preparing step, a coagulated product forming step, a particle forming step, and a cleaning step.

[Toner Raw Material Mixture Preparing Step]

At the toner raw material mixture preparing step, the slurry containing wax particles and the toner raw materials other than the wax are mixed to obtain the toner raw material mixture. Examples of the toner raw materials other than the wax include, binder resin, a colorant, a charge control agent, and typical toner additives other than these materials. Among such materials, the binder resin is preferably used in a form of the slurry obtained by being powdered. The slurry containing binder resin can be prepared by a typical method. For example, resin particles of the binder resin may be dispersed into an adequate solvent. For example, the resin particles of the binder resin can be obtained by a mechanical pulverization and polymerization of binder resin monomers in a solvent, and a powdering method at the aforesaid step (A). In addition, the binder resin, the colorant and/or the charge control agent is melt-kneaded, and a resulting melt-kneaded product is cooled, and a resulting solidified product is mechanically pulverized, to be used as the slurry as it is, or as the slurry obtained by applying the powdering method in the aforesaid step (A). The melt-kneading is implemented for example by heating the binder resin up to a temperature (commonly in a range of around 80 to 200° C., preferably in a range of around 100 to 150° C.) of at least a melting temperature thereof in a kneading machine. As the kneading machine, it is possible to use typical kneading machines such as a twin screw extruder, a three-roll machine, and a laboplast mill. More specifically, for example one screw or twin screw extruders such as TEM-100B (trade name, manufactured by Toshiba Machine Co., Ltd.), PCM-65/87 (trade name, manufactured by Ikegai Ltd.); and open roll type extruders such as Kneadex (trade name, manufactured by Mitsui Mining Co., Ltd.) can be used. A resulting melt-kneaded product is cooled to obtain a solidified product. The cooled solidified product is mechanically and coarsely pulverized by using the power mills such as the cutter mill, the feather mill, and the jet mill to obtain coarse particles of the binder resin. A particle diameter of the coarse particles includes, but not be limited to, preferably a range of 450 to 1,000 μm, more preferably a range of around 500 to 800 μm. As described above, the toner raw materials other than the wax are used in various forms. It is preferable that the slurry of the wax particles, the slurry of the resin particles of the binder resin, the colorant or a water dispersion thereof, and the charge control agent or a water dispersion thereof are mixed to obtain the toner raw material mixture.

The slurry of the wax particles and the toner materials other than the wax are mixed by typical mixers such as batch or continuous emulsification machines and dispersion machines. The emulsification machines and the dispersion machines may include a mixing tank having a heating section for heating the toner raw material mixture that is a mixture of the slurry of the wax particles and the toner materials other than the wax, an agitating section and/or a rotating section for applying shear force to the toner raw material mixture, and a heat insulating section. Specific examples of the emulsification machine and the dispersion machine include, batch type emulsification machines such as Ultratarax (trade name, manufactured by IKA Japan Co., Ltd.), Polytoron Homogenizer (trade name, manufactured by KINEMATICA), TK Auto Homo Mixer (trade name, manufactured by Tokushu Kika Kogyo Co., Ltd.); continuous type emulsification machines such as Ebara Milder (trade name, manufactured by Ebara Corp.), TK Pipe Line Homo-Mixer, TK Homomic Line Flow, Filmics (trade name, manufactured by Tokushu Kikai Kogyo Co., Ltd.), Colloid Mill (trade name, manufactured by Shinko Pantec Co., Ltd.), Slasher, Trigonal Wet Fine Pulverizer (trade name, manufactured by Mitsui Miike Kakoki Co., Ltd.), Cavitoron (trade name, manufactured by Eurotec Ltd.), and Fine Flow Mill (trade name, manufactured by Pacific Machinery and Engineering Co., Ltd.); and Clearmix (trade name, manufactured by M.Technique Co., Ltd.), and Filmics (trade name, manufactured by Tokushu Kika Kogyo Co., Ltd.). Mixture of the slurry containing wax particles with the toner materials other than the wax is preferably implemented by the emulsification machines, the dispersion machines or the mixers as described above at a room temperature, and completed in one to five hours. The resulting toner raw material mixture is applied to the following coagulated product forming step.

Specific examples of the binder resin include an acrylic resin, polyester, polyurethane, and an epoxy resin. The acrylic resin can be readily transformed to fine particles by an emulsion polymerization method and thereby can be especially preferably used as the binder resin when a toner is manufactured by an emulsion condensation method. As the acrylic resin, ingredients are not particularly limited, but an acid group-containing acrylic resin can be preferably used. For example, the acid group-containing acrylic resin can be manufactured by jointly applying an acrylic resin monomer containing an acid group or a hydrophilic radical and/or a vinyl monomer containing an acid group or a hydrophilic radical, in association with polymerization of the acrylic resin monomer or polymerization of the acrylic resin monomer and the vinyl monomer. As the acrylic resin monomer, there may be used the well-known acrylic resin monomers, and examples thereof includes acrylic acid occasionally having a substitution group, methacrylic acid occasionally having a substitution group, acrylic acid ester occasionally having a substitution group, and methacrylic acid ester occasionally having a substitution group. Specific examples of the acrylic resin monomers include, acrylic acid ester monomers such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; methacrylic acid ester monomers such as ethyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate; (meth)acrylic acid ester monomers having a hydroxyl group such as hydroxyethyl acrylate, and hydroxypropyl methacrylate. The acrylic resin monomers may be used alone or in combination. As the vinyl monomer, there may be used the well-known vinyl monomers, and examples thereof include, styrenes, α-methylstyrenes, vinyl bromides, vinyl chlorides, vinyl acetates, and (meth)acrylonitriles. These vinyl monomers may be used alone or in combination. The polymerization is effected by use of a typical radical initiator in accordance with a solution polymerization method, a suspension polymerization method, an emulsification polymerization method, or the like method.

Polyester has excellent transparency and is able to provide high powder flowability, low temperature fixing property, secondary color reproducibility to the toner particles obtained, thus being preferably used as the binder resin of a color toner. As polyester, well known ingredients may be used, including polycondensations composed of a polybasic acid and a polyhydric alcohol. As the polybasic acid, ingredients known as a polyester monomer may be used and examples thereof include, aromatic carboxylic acids such as terephthalic acid, isophthalic acid, phthalic anhydride, trimellitic anhydride, pyromellitic acid, naphthalenedicarboxylic acid; aliphatic carboxylic acids such as maleic anhydride, fumaric acid, succinic acid, alkenylsuccinic anhydride, and adipic acid; and methyl esterified compounds of these polybasic acids. These polybasic acids may be used alone or in combination. As polyhydric alcohol, ingredients known as a polyester monomer may be used and examples thereof include, aliphatic polyhydric alcohols such as ethylene glycol, propylene glycol, butanediol, hexanediol, neopentyl glycol, and glycerin; alicyclicpolyhydric alcohols such as cyclohexanediol, cyclohexanedimethanol, and hydrogenated bisphenol A; and aromatic diols such as ethylene oxide adduct of bisphenol A, and polypropylene adduct of bisphenol A. These polyhydric alcohols may be used alone or in combination. A polycondensation reaction of the polybasic acid and the polyhydric alcohol can be implemented in a usual manner, for example, by bringing the polybasic acid into contact with the polyhydric alcohol in the presence or the absence of the organic catalyst and under the presence of a polycondensation catalyst, and is finished when an acid value, a softening point and the like of polyester to be generated have achieved predetermined values. Polyester is thus obtained. A demethanol polycondensation reaction is effected with the application of methyl esterified compounds of the polybasic acid to a portion of the polybasic acid. By changing a compounding ratio and a response ratio and the like of the polybasic acid to the polyhydric alcohol as needed, for example the carboxyl group content at a polyester terminus can be adjusted and eventually a property of polyester to be obtained can be degenerated. Moreover, when trimellitic anhydride is used as the polybasic acid, altered polyester is obtained also by facile introduction of a carboxyl group into a main chain of polyester. Also, polyester may be used by grafting a acrylic resin.

As polyurethane, well-known ingredients may be used and polyurethane having an acid group or a basic group can be preferably used. The polyurethane having an acid group or a basic group can be manufactured in accordance with a well-known method. For example, it is only necessary to achieve addition polymerization using diol having an acid group or a basic group, polyol, and polyisocyanate. Examples of the diol having an acid group or a basic group include dimethylolpropionic acid, and N-methyldiethanolamine. Examples of the polyol include polyether polyols such as polyethylene glycol, polyester polyol, acrylic polyol, and polybutadiene polyol. Examples of the polyisocyanate include tolylene diisocyanate, hexamethylene diisocyanate, and isophorone diisocyanate. These components may be used alone or in combination.

Non-limiting examples that can be preferably used as an epoxy resin include epoxy-based resins having an acid group or a basic group. The epoxy-based resins having an acid group or a basic group can be manufactured by for example achieving addition or addition polymerization of polycarboxylic acids such as adipic acid, and trimellitic anhydride; or amines such as dibutylamine, and ethylenediamine; to the epoxy resin as a base.

In view of an easy granulating operation, a kneading property with a colorant, uniformity in shapes and sizes of the toner particles that are obtained, among the above binder resins, the binder resin having a softening point of 150° C. or less is preferable, and the binder resin having a softening point of 60 to 150° C. is especially preferable, and the binder resin further having a weight-average molecular weight of 5,000 to 500,000 is more preferable. These binder resins can be used alone or in combination. Moreover, two or more binder resins having differences in any or all of a molecular weight, monomer components and the like among the like binder resins can be used in combination.

The slurry containing wax particles may be used so that an amount of the wax particles is 0.2 to 20 parts by weight based on 100 parts by weight of the binder resin.

As the colorant, it is possible to use an organic pigment, an inorganic dye, and an inorganic pigments, which are commonly used in the electrophotographic field. A black colorant includes, for example, carbon black, copper oxide, manganese dioxide, aniline black, activated carbon, non-magnetic ferrite, magnetic ferrite, and magnetite. An yellow colorant includes, for example, yellow lead, zinc yellow, cadmium yellow, yellow iron oxide, mineral fast yellow, nickel titanium yellow, navel yellow, naphtol yellow-S, hanza yellow-G, hanza-yellow 10G, benzidine yellow-G, benzidine yellow-GR, quinoline yellow lake, permanent yellow-NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138. An orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43. A red colorant includes, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222. A purple colorant includes, for example, manganese purple, fast violet B, and methyl violet lake. A blue colorant includes, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60. A green colorant includes, for example, chromium green, chromium oxide, pigment green B, malachite green lake, final yellow green G, and C.I. pigment green 7. A white colorant includes, for example, those compounds such as zinc oxide, titanium oxide, antimony white, and zinc sulfide. The colorants may be used each alone or two or more of the colorants of different colors may be used in combination. Further, two or more of the colorants with the same color may be used in combination. A usage of the colorant includes, but not be limited to, preferably a range of 0.1 to 20 parts by weight based on 100 parts by weight of the binder resin, and more preferably a range of 0.2 to 10 parts by weight based on the same.

As the charge control agent, it is possible to use agents for controlling positive charges and agents for controlling negative charges, which are commonly used in this field. The charge control agent for controlling positive charges includes a nigrosine dye, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The charge control agent for controlling negative charges includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a fatty acid soap, long-chain alkylcarboxylic acid salt, and a resin acid soap. The charge control agent may be used each alone and according to need, two or more of the agents may be used in combination. A usage of the charge control agent is not limited to a particular level and may be selected as appropriate from a wide range. A preferable usage of the charge control agent is 0.5 to 3 parts by weight based on 100 parts by weight of the binder resin.

[Coagulated Product Forming Step]

At the coagulated product forming step, a coagulating agent is added to the toner raw material mixture to obtain the slurry containing a toner coagulated product. The coagulating agent may be added without being agitated, but is preferably added in a state being agitated. As the coagulating agents, well-known ingredients may be used and water-soluble polyvalent metal compounds are preferable among such coagulating agents. Examples of the water-soluble polyvalent metal compounds include polyvalent metal halides such as calcium chloride, barium chloride, magnesium chloride, zinc chloride, and aluminum chloride; polyvalent metal salt such as calcium nitrate, aluminum sulfate, and magnesium sulfate; inorganometallic salt polymer such as poly aluminum chloride, poly aluminum hydroxide, and calcium polysulfide. Among such compounds the polyvalent metal salt is preferable, and bivalent or trivalent metal sulfates such as magnesium sulfate and aluminum sulfate are more preferable. A usage of the water-soluble polyvalent metal compounds is not limited to a particular level, and may be selected as appropriate from a wide range, in view of types of the binding resin and other toner components, a particle diameter of the binding resin, and the like corresponding to a particle diameter of the toner particles intended to finally obtain. A preferable usage of the water-soluble polyvalent metal compounds is 0.1 to 10 parts by weight based on 100 parts by weight of a total amount of the binder resin particles.

[Particle Forming Step]

At the particle forming step, the slurry containing toner coagulated products that is obtained at the coagulated product forming step is heated to form the toner particles. The heating temperature is not limited to a particular level, but a temperature around a glass rearrangement point of the binding resin is preferable. A particle diameter of the toner particles that are obtained can be adjusted by changing a heating temperature and a heating period as appropriate.

[Cleaning Step]

At the cleaning step, the toner particles are isolated from the slurry containing toner particles that is obtained at the particle forming step, cleaned with a pure water, and then dried to obtain the toner particles of the invention. A method for isolating the toner particles from the slurry includes typical isolation devices such as a filtration device and a centrifuge. The preferable pure water used for cleaning has electrical conductivity of 20 μS/cm or less. Such pure water can be obtained by well-known methods such as an activated carbon method, an ion exchange method, a distillation method, and a reverse osmosis method. Also, a water temperature of the pure water is preferably around 10 to 80° C. The toner particles may be cleaned until electrical conductivity of a cleaning water that has been used for cleaning the toner particles is reduced to a level of 50 μS/cm or less. The toner particles are cleaned, and thereafter isolated from the cleaning water, and then dried to obtain the toner of the invention.

The toner of the invention is composed of the toner particles having a diameter reduced to a level of 3.5 to 6.5 μm, in which the wax having a reduced diameter is uniformly dispersed. The toner of the invention offers advantages in excellent image reproducibility and prevention of various problems that are caused by bleeding out of the wax.

The toner of the invention may be treated with addition of additives to improve surface quality. As the additives, there may be used the well-known additives and examples thereof include silica and titanic oxide each having a surface treated with silica, titanic oxide, a silicone resin, and a silane coupling agent. Moreover, a usage of the additives is 1 to 10 parts by weight based on 100 parts by weight of the toner.

The toner of the invention can be used as a one-component developer and also as a two-component developer. When the toner is used as the one-component developer, the toner, which is used alone without using a carrier, is charged by friction with a blade and a fur brush on a developing sleeve, and thereby attracted onto a developing sleeve, and then conveyed, to form an image.

Furthermore, when the toner is used as the tow-component developer, the toner is used with the carrier. As the carrier, there may be used the well-known carriers and examples thereof include single ferrite or composite ferrite composed of iron, copper, zinc, nickel, cobalt, manganese, and chromium; and carrier core particles having a surface coated with coating substances. As the coating substance, there may be used the well-known coating substances and examples thereof include polytetrafluoroethylene, monochlorotrifluoroethylene polymer, polyvinylidene fluoride, a silicone resin, a polyester resin, metal compounds composed of di-tert-butylphenol, a styrene resin, an acrylic resin, polyacid, polyvinyl butyral, nigrosine, an aminoacrylic resin, a basic dye, lake of a basic dye, silica fine particles, and alumina fine particles. The coating substances as described above are preferably selected in accordance with toner components. In addition, these coating substances may be used alone or in combination. An average particle diameter of the carrier is preferably 10 to 100 μm, more preferably 20 to 50 μm.

EXAMPLES

The invention will be specifically described referring to the following examples.

Example 1

Wax coarse particles having a particle diameter of 500 to 800 μm was prepared by coarsely pulverizing 100 parts by weight of a polyester wax (a releasing agent, a melting point of 85° C.) by use of a cutter mill (trade name: VM-16, manufactured by Orient Corp.). The wax coarse particles in an amount of 94 parts by weight were mixed with 30% by weight of a water solution containing a dispersion stabilizer (trade name: Joncryl 70, manufactured by Jonson Polymer Co.) in combination with a surface-active agent (trade name: New Call N-2320, manufactured by Nippon Nyukazai Co., Ltd.) at a rate of 1 to 1 (a part by weight basis), to prepare water-based slurry containing wax coarse particles. This water-based slurry was directed under pressure of 160 MPa through a nozzle having an internal diameter of 0.3 mm, and pretreated, and then adjusted to prepare the water-based slurry having a wax particle diameter of 100 μm or less.

The water-based slurry of the wax coarse particles was pressurized at 220 MPa and heated to 90° C. inside a pressure-resistant airtight container, and then supplied from a pressure-resistant pipe mounted on the pressure-resistant airtight container to a pressure-resistant nozzle mounted on an outlet of the pressure-resistant pipe. The pressure-resistant nozzle is a pressure-resistant multiple nozzle having a length of 0.5 cm, which is configured so that two liquid flowing holes having a hole diameter of 0.143 mm are substantially parallel to each other in a longitudinal direction of the nozzle. At an inlet of the nozzle, a temperature of the water-based slurry was 110° C. and a pressure imparted to the water-based slurry was 220 MPa. At an outlet of the nozzle, a temperature of the water-based slurry was 100° C. and a pressure imparted to the water-based slurry was 45 MPa. The water-based slurry discharged from the pressure-resistant nozzle was directed into a corrugated tube-type cooling machine connected to the outlet of the pressure-resistant nozzle, and cooled. At an outlet of the cooling machine, a temperature of the water-based slurry was 28° C. and a pressure imparted to the water-based slurry was 38 MPa. The water-based slurry discharged from the outlet of the cooling machine was directed into the multistage depressurization apparatus connected to the outlet of the cooling machine and then depressurized therein. The water-based slurry discharged from the multistage depressurization apparatus contained the wax particles having a particle diameter of 100 to 500 nm.

The obtained wax particles in an amount of 5 parts by weight (an converted amount to a solid content), a styrene acrylic resin particles having an average particle diameter of 150 nm (a weight-average molecular weight: 55,000, Mw/Mn=45, a softening temperature: 130° C.) in an amount of 88.5 parts by weight (an converted amount to a solid content), an charge control agent (trade name: TRH, manufactured by Hodogaya Chemical Co., Ltd.) in an amount of 1.5 parts by weight, and a colorant (KET. BLUE 111) in an amount of 5 parts by weight, were mixed using a mixer (trade name: Henschel Mixer, manufactured by Mitsui Mining Co., Ltd.) to prepare a toner raw material mixture.

When under agitation of 2,000 rpm in a homogenizer, 0.1% by weight of a magnesium sulfate solution was dropped in small portions into the toner raw material mixture to achieve 10 parts by weight of the magnesium sulfate solution in total, and then a resulting mixture was agitated for an hour, production of a toner coagulated product was conformed with eyes and the water-based slurry of the toner coagulated product was prepared. The water-based slurry containing toner coagulated product was agitated for 2 hours at a temperature of 75° C. to form the toner particles having a uniformed particle diameter and a uniformed shape in the water-based slurry. The toner particles isolated from the slurry by filtration were cleaned 3 times with a pure water (0.5 μS/cm), and thereafter dried by a vacuum drier to produce the toner having a particle diameter in a range of 3.5 to 6.5 μm of the invention. Note that the pure water was prepared from tap water using an ultrapure water production system (trade name: Ultra Pure Water System CPW-102, manufactured by ADVANTEC Co., Ltd.). Electrical conductivity of the water is measured using LACOM Tester (trade name: EC-PHCON 10, manufactured by luchi Seieido Co., Ltd.). Also, a particle diameter of the toner was measured, using a scanning electron microscope (manufactured by Keyence Corp.), by conducting an observation to have a maximum diameter and a minimum diameter of the toner particles at a magnification of 1,000 times per high-power field, with respect to 100 high-power fields. Both of the maximum diameter and the minimum diameter were within a range of 3.5 to 6.5 μm, which is an object of the invention.

Example 2

The water-based slurry containing carnauba wax particles having a particle diameter of 80 to 450 nm was prepared by operating as in the case of Example 1, except to use a carnauba wax (a melting point: 92° C.) in place of a polyester wax. The carnauba wax particles obtained in an amount of 5 parts by weight (an converted amount to a solid content), a styrene acrylic resin particles having an average particle diameter of 150 nm (a weight-average molecular weight: 55,000, Mw/Mn=45, a softening temperature: 130° C.) in an amount of 88.5 parts by weight (an converted amount to a solid content), an charge control agent (trade name: TRH, manufactured by Hodogaya Chemical Co., Ltd.) in an amount of 1.5 parts by weight, and a colorant (KET. BLUE 111) in an amount of 5 parts by weight, were mixed using a mixer (trade name: Henschel Mixer, manufactured by Mitsui Mining Co., Ltd.) to prepare a toner raw material mixture.

When under agitation of 2,000 rpm in a homogenizer, 0.1% by weight of a magnesium sulfate solution was dropped in small portions into the toner raw material mixture to achieve 10.5 parts by weight of the magnesium sulfate solution in total, and then a resulting mixture was agitated for an hour, production of a toner coagulated product was conformed with eyes and the water-based slurry of the toner coagulated product was prepared. The water-based slurry containing toner coagulated product was agitated for 2 hours at a temperature of 75° C. to form the toner particles having a uniformed particle diameter and a uniformed shape in the water-based slurry. The toner particles isolated from the slurry by filtration were cleaned 3 times with a pure water (0.5 μS/cm), and thereafter dried by a vacuum drier to produce the toner having a particle diameter in a range of 3.5 to 6.5 μm of the invention.

Example 3

Performance tests as described below were conducted with respect to the toner in Examples 1 and 2.

[Image Density]

The toner that was obtained in Examples 1 and 2 was put in a developer tank of developing device of testing image forming apparatus to thereby form an unfixed test image including a solid image part, such that a toner amount attached to a sheet designed only for full color: PP106A4C (trade name, manufactured by Sharp Corp., hereinafter referred to simply as a "recording sheet") was 0.6 mg/cm$^2$. As the testing image forming apparatus, there was used a commercially available image forming apparatus (trade name: AR-C 150 Digital Full Color Multifunction Printer, manufactured by Sharp Corp.), a fixing device of which was removed as a result of remodeling of a developing device into a device for a non-magnetic one-component developer. The unfixed image formed was fixed by an external fixing machine. An image thus obtained was used as an evaluation image. As the external fixing machine, there was used an oil-less fixing device which was taken out from a commercially available image forming apparatus (trade name: AR-C 160 Digital Full Color Multifunction Printer, manufactured by Sharp Corp.). The oil-less fixing device refers to a fixing device which performs fixing without applying a releasing agent onto a heating roller.

An optical density of the solid image part in the evaluation image thus obtained was measured. The measurement was conducted using a spectral colorimetric densitometer (trade name: X-Rite 938, manufactured by Nippon Heiban Insatsukizai Co.) All optical densities measured on 100 samples are 1.40 or more. It was thus turned out that the image density was very high.

[Fogging Level]

First, whiteness defined by JIS P 8148 on an A4-sized recording sheet (PP106A4C) defined by JIS P 0138 was measured using a whiteness checker (trade name: Z-Σ90 Color Measuring System, manufactured by Nippon Denshoku Industries Co., Ltd.). The obtained value was defined as a first measurement value W1. The toner of the invention was put into a developing tank of developing device of commercially available digital multifunction printer (trade name: AR-620, manufactured by Sharp Corp.), to thereby form an evaluation image containing a while circle part having a diameter of 55 mm and a black solid part surrounding the while circle part onto three recording sheets of which whiteness had been measured. By use of the above-described whiteness checker, whiteness of the white circle part on each of the evaluation images was measured, and an average thereof was then calculated. The obtained value was defined as a second measurement value W2. A fogging density W (%) was calculated based on the following formula using the first measurement value W1 and the second measurement value W2. All the fogging densities W calculated on 100 samples were 1.0% or less. It was thus obvious that fogging is hard to be caused.

$$W(\%)=[(W1-W2)/W1]\times 100$$

[Scrub Test for Fixing Property]

An unfixed image printed out on a sheet with 75 g/m$^2$ was fixed using an oil-less type external fixing machine (a heat roller system, a diameter of a fixing roller: 40 mm, a diameter of a pressure roller: 35 mm, a processing speed: 205 mm/sec, a nip width: 5 mm, a temperature of the pressure roller: 135° C., a fixing temperature: 150° C.). Then, a scrub test, in which an eraser to which 1 kg of a load was applied was traveled back and forth 3 times on a surface of the fixed image, was conducted. A change in image density before and after the test was measured by a Macbeth reflection density meter to thereby obtain a residual ratio of the image. A minimum residual ratio was evaluated by preparing a graph from 7 points of measurement points each having a different density. All of the minimum residual ratio obtained from 100 samples were 90% or more. It was thus revealed that the fixed image has an excellent fixing property.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and a range of equivalency of the claims are therefore intended to be embraced therein.

What is claimed is:

1. A method for manufacturing a toner, comprising:

coagulating resin particles including at least binder resin, and wax particles having a diameter in a range of 30 to 600 nm obtained from slurry containing wax coarse particles by a high-pressure homogenizer method; and heating a resulting coagulated product, wherein the high-pressure homogenizer method includes a pulverizing step for obtaining heated and pressurized slurry containing wax particles by passing the slurry containing wax coarse particles through a pressure-resistant nozzle under heat and pressure and pulverizing the wax coarse particles; a cooling step for cooling down the slurry obtained at the pulverizing step; and a depressurizing step for gradually depressurizing the slurry cooled down at the cooling step to a pressure level at which no bubbling is caused.

2. The method of claim 1, wherein the slurry containing wax coarse particles is slurry prepared by dispersing the wax coarse particles into water.

3. The method of claim 1, wherein the slurry containing wax coarse particles is slurry prepared by dispersing the wax coarse particles into a mixture of water and a dispersion stabilizer.

4. The method of claim 1, wherein the slurry is pressurized at a pressure in a range from 50 MPa to 250 MPa, and heated to 50° C. or more at the pulverizing step.

5. The method of claim 1, wherein the slurry is pressurized at a pressure in a range from 50 MPa to 250 MPa, and heated to a melting point of the wax or more at the pulverizing step.

6. The method of claim 1, wherein the pressure-resistant nozzle is a multiple nozzle.

7. The method of claim 1, wherein the pressure-resistant nozzle is a nozzle having a liquid flowing passage therein provided with at least one collision wall against which a liquid flowing through the liquid flowing passage collides.

8. The method of claim 1, wherein at the depressurizing step, a pressure on the slurry is gradually reduced to a level at which no bubbling is caused by passing the pressurized slurry containing wax particles, which is cooled down at the cooling step, through a multistage depressurization apparatus for performing stepwise depressurization.

9. The method of claim 8, wherein the multistage depressurization apparatus comprises:

an inlet passage for leading the pressurized slurry containing wax particles into the multistage depressurization apparatus;

an outlet passage in communication with the inlet passage, for discharging the slurry containing wax particles to outside of the multistage depressurization apparatus; and a multistage depressurizing section disposed between the inlet passage and the outlet passage, to which two or more depressurizing members are coupled via coupling members, for performing stepwise depressurization.

10. The method of claim 1, wherein the binder resin is acrylic resin.

* * * * *